US009673500B2

(12) United States Patent
Ishizaki et al.

(10) Patent No.: US 9,673,500 B2
(45) Date of Patent: Jun. 6, 2017

(54) ARTIFICIAL DIELECTRIC RESONATOR AND ARTIFICIAL DIELECTRIC FILTER USING THE SAME

(71) Applicant: Huawei Technologies Co., Ltd., Shenzhen, Guangdong (CN)

(72) Inventors: Toshio Ishizaki, Otsu (JP); Naoki Hama, Otsu (JP)

(73) Assignee: Huawei Technologies Co., Ltd., Shenzhen (CN)

( * ) Notice: Subject to any disclaimer, the term of this patent is extended or adjusted under 35 U.S.C. 154(b) by 120 days.

(21) Appl. No.: 14/460,120

(22) Filed: Aug. 14, 2014

(65) Prior Publication Data

US 2015/0002244 A1 Jan. 1, 2015

Related U.S. Application Data

(63) Continuation of application No. PCT/JP2013/053440, filed on Feb. 13, 2013.

(30) Foreign Application Priority Data

Feb. 14, 2012 (JP) ..... 2012-029991

(51) Int. Cl.
*H01P 1/203* (2006.01)
*H01P 7/10* (2006.01)
*H01P 7/08* (2006.01)

(52) U.S. Cl.
CPC ..... *H01P 1/20309* (2013.01); *H01P 1/203* (2013.01); *H01P 1/20318* (2013.01); *H01P 7/082* (2013.01); *H01P 7/10* (2013.01)

(58) Field of Classification Search
CPC .... H01P 1/203; H01P 1/2039; H01P 1/20318; H01P 7/06; H01P 7/10; H01P 1/20354; H01P 1/20372; H01P 1/20381
(Continued)

(56) References Cited

U.S. PATENT DOCUMENTS 6,943,644 B2 * 9/2005 Hidaka ..... H01P 1/20381 333/126
7,619,495 B2 11/2009 Albacete et al.
(Continued)

FOREIGN PATENT DOCUMENTS

CN 1237007 A 12/1999
DE 1965065 A1 1/1971
(Continued)

OTHER PUBLICATIONS

Jim Stiles, "Transmission Lines and Waveguides", Feb. 20, 2009, Univ. of Kansas, p. 19.*
(Continued)

*Primary Examiner* — Stephen E Jones
(74) *Attorney, Agent, or Firm* — Leydig, Voit & Mayer, Ltd.

(57) ABSTRACT

An artificial dielectric resonator that can enhance a relative dielectric constant in a basic mode is provided. The artificial dielectric resonator 1 has a first series metal strip group 2 including a plurality of metal strips 20 each in a thin sheet shape arranged with microscopic gaps 20G provided in a longitudinal direction, and a second series metal strip group 3 including a plurality of metal strips 30 each in a thin sheet shape arranged with microscopic gaps 30G provided in a longitudinal direction, the first series metal strip group 2 and the second series metal strip group 3 are disposed close to each other in a thickness direction of the metal strips 20 and 30, and the metal strip 20 or 30 of one metal strip group 2 or 3 is disposed to face and cross gap 30G or 20G of the other metal strip group 3 or 2.

8 Claims, 7 Drawing Sheets

(58) Field of Classification Search
USPC ..... 333/204, 205, 202, 219.1, 219, 235
See application file for complete search history.

(56) References Cited

U.S. PATENT DOCUMENTS

| | | | | |
|---|---|---|---|---|
| 2001/0022542 | A1 | 9/2001 | Hiratsuka et al. | |
| 2011/0095851 | A1* | 4/2011 | Wyland | H01L 23/66 333/219 |
| 2011/0098033 | A1* | 4/2011 | Britz | H01Q 3/44 455/422.1 |
| 2011/0115684 | A1* | 5/2011 | Greegor | H01P 1/207 343/776 |
| 2012/0049649 | A1* | 3/2012 | Fukunaga | H01P 1/20381 307/104 |

FOREIGN PATENT DOCUMENTS

| | | | |
|---|---|---|---|
| GB | 1297268 | A | 11/1972 |
| GB | 2272332 | A | 5/1994 |
| JP | H06181412 | A | 6/1994 |
| JP | H0758505 | A | 3/1995 |
| JP | 2003133820 | A | 5/2003 |
| JP | 2005033579 | A | 2/2005 |
| JP | 2007306563 | A | 11/2007 |
| JP | 2008028010 | A | 2/2008 |

OTHER PUBLICATIONS

Awai, "Artificial Dielectric Resonators for Miniaturized Filters," IEEE Microwave Magazine, pp. 55-64, Institute of Electrical and Electronics Engineers, New York, New York (Oct. 2008).

Kubo et al., "High Q or High Effective Permittivity Artificial Dielectric Resonator in a Waveguide," IEICE Trans. Electron., vol. E88-C, No. 7, pp. 1412-1419, The Institute of Electronics, Information and Communication Engineers, Tokyo, Japan (Jul. 2005).

* cited by examiner

ARTIFICIAL DIELECTRIC RESONATOR AND ARTIFICIAL DIELECTRIC FILTER USING THE SAME

CROSS-REFERENCE TO RELATED APPLICATIONS

This application is a continuation of International Patent Application No. PCT/JP2013/053440, filed on Feb. 13, 2013, which claims priority to Chinese Patent Application No. JP2012-029991, filed on Feb. 14, 2012, both of which are hereby incorporated by reference in their entireties.

TECHNICAL FIELD

The present invention relates to an artificial dielectric resonator and an artificial dielectric filter using the same.

BACKGROUND

In recent years, there have not been a few cases in which high-frequency filters that are used in a microwave band and the like are made up of dielectric resonators using dielectric substances with high relative dielectric constants for the purpose of downsizing and enhancement in performance by downsizing. By forming a dielectric substance into a block in a specific size and shape, a dielectric resonator can be resonated at a desired frequency that is fixed by the size and shape of the dielectric substance and the relative dielectric constant.

A dielectric resonator using ceramics with a high relative dielectric constant (dielectric ceramics) as the material of the dielectric substance is widely known. When an electric field is applied to the molecules that configure the dielectric ceramics, the bound electrons in the molecules migrate and are polarized, and thereby the dielectric ceramics shows a high relative dielectric constant. As the relative dielectric constant of dielectric ceramics, the dielectric ceramics having relative dielectric constants of 20 to 100 can be generally put to practical use when smallness of loss at a high frequency and temperature stability are taken into consideration.

As a dielectric resonator, the dielectric resonator using an artificial dielectric substance (an artificial dielectric resonator) has been also proposed (For example, Patent Literature 1). An artificial dielectric substance is formed from assembly of a number of metallic pieces. The artificial dielectric substance behaves as a dielectric substance as a result that free electrons that are present in the metallic pieces migrate and are polarized when an electric field is applied thereto, and can obtain a high equivalent relative dielectric constant in accordance with the size and the shape of the metallic pieces, depending on the number of free electrons and the length of the migration distance. Note that artificial dielectric substances are disposed in a certain base material in order to retain the respective metallic pieces.

Further, an artificial dielectric substance has such anisotropy that the relative dielectric constant changes depending on which direction of the metallic pieces an electric field is applied as described in Patent Literature 1. Due to the anisotropy, the metallic pieces are disposed so that in resonance (a basic mode) at a desired frequency, the relative dielectric constant becomes high, and at other resonances (spurious mode) at frequencies relatively close to the desired frequency, the relative dielectric constant becomes low, whereby the artificial dielectric resonator can separate these frequencies, and thereby can suppress the spurious mode.

CITATION LIST

Patent Literature

[Patent Literature 1] Japanese Patent Laid-Open No. 2003-133820

SUMMARY

Technical Problem

As above, an artificial dielectric resonator can obtain an excellent characteristic which ordinary resonators of dielectric ceramics do not have, in accordance with the sizes, shapes and disposition of metallic pieces. However, an artificial dielectric resonator still has a room for improvement, in order to respond to the request of customers of today for high-frequency filters (artificial dielectric filters) using the artificial dielectric resonators. In particular, in order to respond to the request for downsizing, an artificial dielectric resonator needs to further enhance the relative dielectric constant in a basic mode.

In the artificial dielectric filter using artificial dielectric resonators, a plurality of artificial dielectric resonators are usually disposed therein, and input/output terminals that are coupled to the artificial dielectric resonators to exchange signals with an outside are disposed. By properly controlling the degree of coupling between the input/output terminals and the artificial dielectric resonators (input/output coupling degree) and an inter-stage coupling degree between two artificial dielectric resonators, a filter characteristic (for example, a Chebyshev type or the like) of a desired band width is implemented with respect to a predetermined basic mode. With respect to an artificial dielectric filter, the degree of input/output coupling is small, and the band width of the filter characteristic tends to be narrow, and it is sometimes difficult to obtain the desired filter characteristic.

Further, an artificial dielectric filter is also desired to implement accurate positioning of a plurality of artificial dielectric resonators while restraining a lot of time and effort from being taken by the manufacture process, for the purpose of control of the inter-stage coupling degree between two artificial dielectric resonators.

The present invention is provided in the light of the foregoing circumstances, and an objective of the present invention is to provide an artificial dielectric resonator that can further enhance a relative dielectric constant in a basic mode, and to provide an artificial dielectric filter that has a large input/output coupling degree, and can implement accurate positioning of the artificial dielectric resonators.

Solution to Problem

In order to attain the foregoing described objective, an artificial dielectric resonator according to a preferable embodiment of the present invention has a first series metal strip group including a plurality of metal strips each in a thin sheet shape arranged with microscopic gaps provided in a longitudinal direction, and a second series metal strip group including a plurality of metal strips each in a thin sheet shape arranged with microscopic gaps provided in a longitudinal direction, where the first series metal strip group and the second series metal strip group are disposed close to each other in a thickness direction of the metal strips, and the metal strip of one of the metal strip groups is disposed to face and cross the gap of the other metal strip group.

It is preferable that in the artificial dielectric resonator, the first series metal strip group and the second series metal strip group separately form annular shapes. More preferably, the artificial dielectric resonator further has a third series metal strip group including a plurality of metal strips each in a thin sheet shape annularly arranged with microscopic gaps provided in a longitudinal direction, the third series metal strip group being disposed coaxially with the first series metal strip group and close to the first series metal strip group in width directions of the metal strips, and a fourth series metal strip group including a plurality of metal strips each in a thin sheet shape annularly arranged with microscopic gaps provided in a longitudinal direction, the fourth series metal strip group being disposed coaxially with the second series metal strip group and close to the second series metal strip group in width directions of the metal strips.

It is preferable that an artificial dielectric filter includes a plurality of the artificial dielectric resonators, and two input/output terminals, where the artificial dielectric resonators which are adjacent to each other are coupled to each other, and the input/output terminals are coupled to the artificial dielectric resonators which are adjacent to the input/output terminals.

It is preferable that in the artificial dielectric filter, the respective input/output terminals are directly connected to the metal strips of the artificial dielectric resonators which are adjacent to the input/output terminals.

It is preferable that in the artificial dielectric filter, the plurality of artificial dielectric resonators are formed in an integral multilayer substrate so that a relative position of the plurality of artificial dielectric resonators is fastened to achieve a predetermined inter-stage coupling degree.

It is preferable that in the artificial dielectric filter, the artificial dielectric resonator resonates with a basic mode set as a TE01□ mode.

Advantageous Effect of Invention

According to the present invention, the first series metal strip group and the second series metal strip group are disposed close to each other in the thickness directions of the metal strips, and the metal strip of one of the metal strip groups is disposed to face and cross the gap of the other metal strip group. Therefore, by a large capacitance therebetween, the artificial dielectric resonator showing an extremely high relative dielectric constant can be provided. Further, the input/output terminal is directly connected to the metal strip by using the artificial dielectric resonator, and a plurality of artificial dielectric resonators are formed in the integral multilayer substrate, whereby the artificial dielectric filter which has a large input/output coupling degree, and implements accurate positioning of the artificial dielectric resonators can be provided.

DESCRIPTION OF EMBODIMENTS

Figure 1:
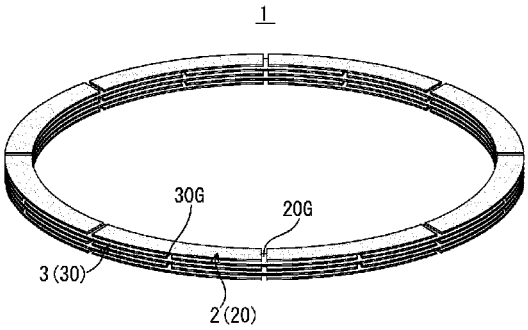
FIG. 1 is a perspective view of an artificial dielectric resonator according to an embodiment of the present invention.
Figure 2:
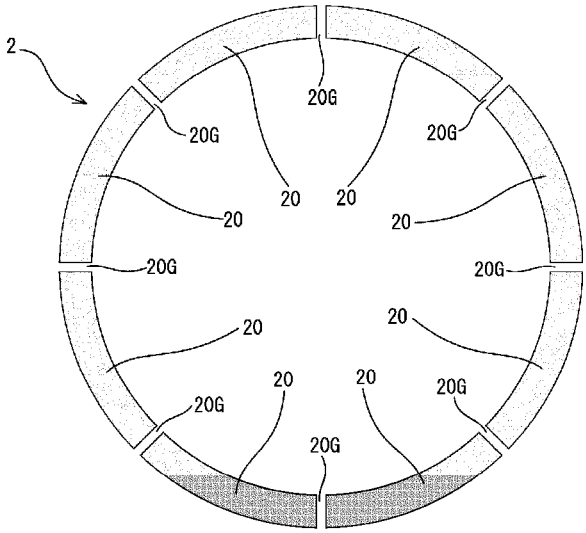
FIG. 2 is a plan view showing a first series metal strip group of the artificial dielectric resonator of the same.
Figure 3:
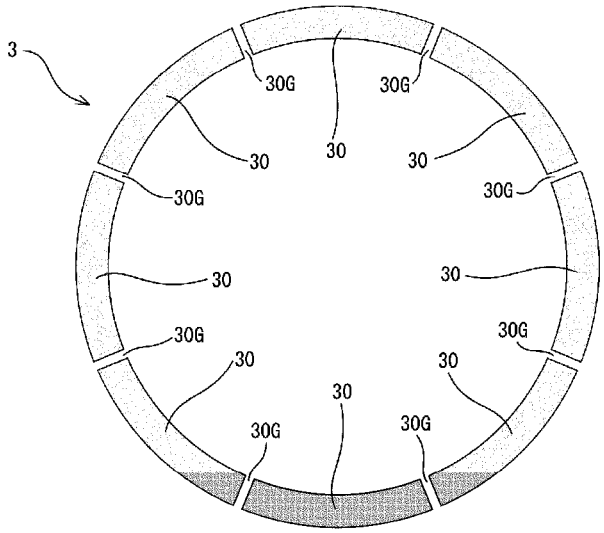
FIG. 3 is a plan view showing a second series metal strip group of the artificial dielectric resonator of the same.

Hereinafter, an embodiment of the present invention will be described with reference to the drawings. As shown in FIGS. 1, 2 and 3, an artificial dielectric resonator 1 according to the embodiment of the present invention has a first series metal strip group 2 including a plurality of metal strips 20, 20, . . . each in a thin sheet shape annularly arranged with microscopic gaps 20G, 20G, . . . provided in a longitudinal direction, and a second series metal strip group 3 including a plurality of metal strips 30, 30, . . . each in a thin sheet shape annularly arranged with microscopic gaps 30G, 30G, . . . provided in a longitudinal direction. The first series metal strip group 2 and the second series metal strip group 3 are disposed close to each other in a thickness direction of the metal strips 20 and 30, and the metal strip 20 or 30 of either one of the metal strip group 2 or 3 is disposed to face and cross the gap 30G or 20G of the other metal strip group 3 or 2.

The metal strips 20 and 30 each in a thin sheet shape are metal pieces with large aspect ratios (widths are short, and lengths are long). Further, in the artificial dielectric resonator 1, the first series metal strip group 2 and the second series metal strip group 3 are disposed in a base material for retaining them (for example, a multilayer substrate which will be described later such as a resin multilayer substrate and an LTCC (low temperature co-fire ceramics) substrate).

In the artificial dielectric resonator 1, metal strip groups similar to the first series metal strip group 2 or the second series metal strip group 3 are properly provided by being stacked in sequence similarly to the positional relation of the first series metal strip group 2 and the second series metal strip group 3. FIG. 1 shows the artificial dielectric resonator in which three layers of the metal strip groups similar to the first series metal strip group 2, and two layers of the metal strip groups similar to the second series metal strip group 3, that is, five layers in total are provided in layer.

In the artificial dielectric resonator 1 as above, free electrons in the metal strips 20 and 30 migrate by an applied electric field, and positive charges or negative charges are present at one end sides of the metal strips 20 and 30, and negative charges or positive charges are present at the other end sides. This state is a state in which the metal strips 20 and 30 cause polarization, and the positive charges and the negative charges which are present configure an electric dipole. As a dipole moment which is obtained by multiplying the amount of charges in the electric dipole and a polarization distance is larger, a higher relative dielectric constant can be obtained.

Therefore, the first series metal strip group 2 and the second series metal strip group 3 each forming an annular shape show a high relative dielectric constant to an annular electric field which is applied. Thereby, the artificial dielectric resonator 1 having the first series metal strip group 2 and the second series metal strip group 3 can have a TE01δ mode in which the direction of the electric field of resonance forms an annular shape as an object basic mode. A TE01δ mode is willingly used as a basic mode, because of small loss.

Figure 4:
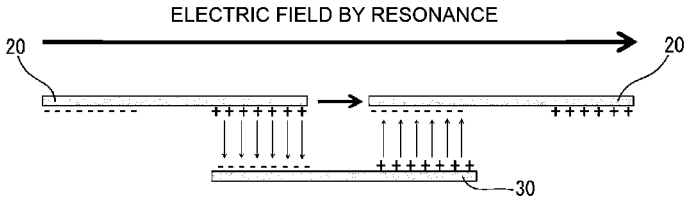
FIG. 4 is a view explaining electric charges that are generated in the first series metal strip group and the second series metal strip group of the artificial dielectric resonator of the same.

Further, the positional relation of the metal strip 20 of the first series metal strip group 2 and the metal strip 30 of the second series metal strip group 3 generates a large capacitance between the metal strip 20 and the metal strip 30. Thereby, as shown in FIG. 4, a larger number of electric charges (positive charges or the negative charges at one end side and the negative charges or the positive charges at the other end side) are stored, whereby the dipolar moment becomes large, and a very high relative dielectric constant can be obtained in the annular direction. Note that the electric fields between the adjacent metal strips 20 and 20 and between the adjacent metal strips 30 and 30 are strong. Further, an electric field occurs between the metal strip 20 and the metal strip 30.

Note that the relative dielectric coefficient can be also adjusted by changing a width of the metal strip 20 and a distance of the gap 20G in the first series metal strip group 2, and a width of the metal strip 30 and a distance of the gap 30G in the second series metal strip group 3, and the like.

If the basic mode is set as the TE01δ mode of a predetermined resonance frequency, the artificial dielectric resonator 1 is downsized. When a spurious mode (for example, a TM11δ mode or the like) having a resonance frequency relatively close to the resonance frequency of the TE01δ mode is present, the size of the artificial dielectric resonator 1 changes, whereby the resonance frequency of the spurious mode changes in accordance with the size thereof, and as a result, the resonance frequencies of the basic mode and the spurious mode can be separated.

Figure 5:
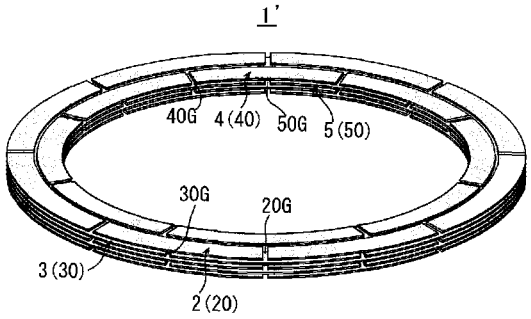
FIG. 5 is a perspective view of a modification of the artificial dielectric resonator of the same.
Figure 6:
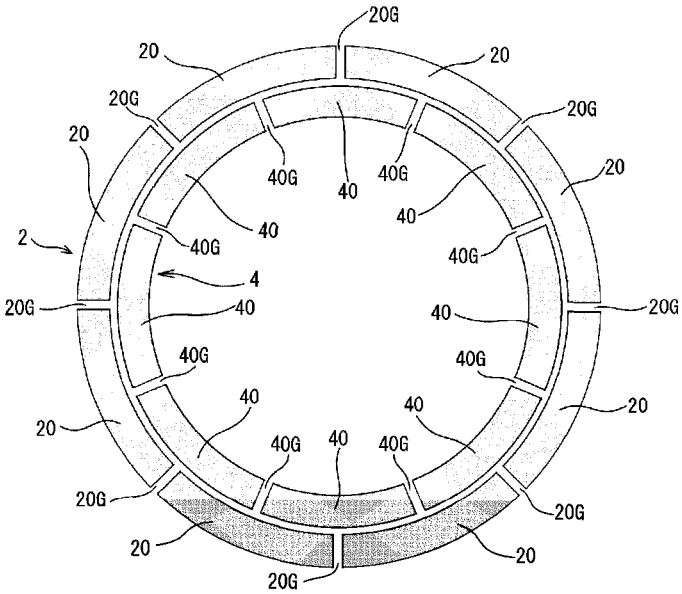
FIG. 6 is a plan view showing a first series metal strip group and a third series metal strip group of the modification of the artificial dielectric resonator of the same.
Figure 7:
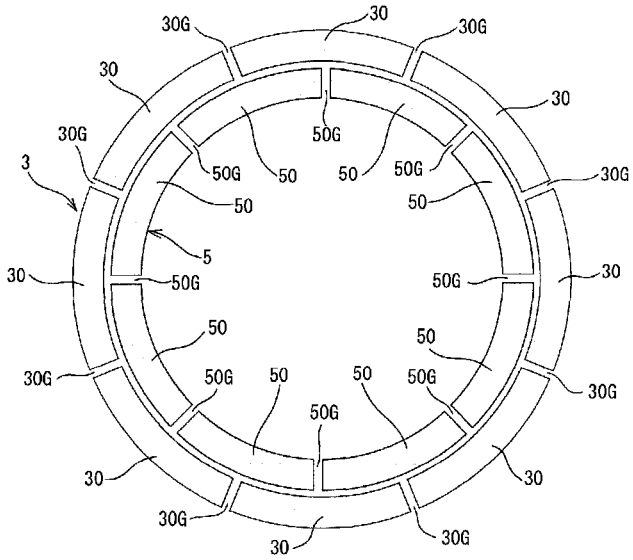
FIG. 7 is a plan view showing a second series metal strip group and a fourth series metal strip group of the modification of the artificial dielectric resonator of the same.

Next, an example of modifying the artificial dielectric resonator 1 will be described. An artificial dielectric resonator 1' further has a third series metal strip group 4 and a fourth series metal strip group 5, in addition to the configuration of the artificial dielectric resonator 1, as shown in FIGS. 5, 6 and 7. Namely, the third series metal strip group 4 includes a plurality of metal strips 40 each in a thin sheet shape annularly arranged with microscopic gaps 40G provided in a longitudinal direction, and is disposed coaxially with the first series metal strip group 2 and close to the first series metal strip group 2 in the width direction of the metal strip 20. The fourth series metal strip group 5 includes a plurality of metal strips 50 each in a thin sheet shape annularly arranged with microscopic gaps 50G provided in a longitudinal direction, and is disposed coaxially with the second series metal strip group 3, and in a close vicinity to the second series metal strip group 3 in the width direction of the metal strip 30.

The artificial dielectric resonator 1' as above also generates capacitances between the metal strip 20 and the metal strip 40, and between the metal strip 30 and the metal strip 50, separately. These capacitances are not so large as the capacitance between the metal strip 20 and the metal strip 30, but contributes to storing a larger number of charges (positive charges or negative charges at one end side, and negative charges or positive charges at the other end side). Thereby, the relative dielectric constant can be enhanced more.

Figure 8:
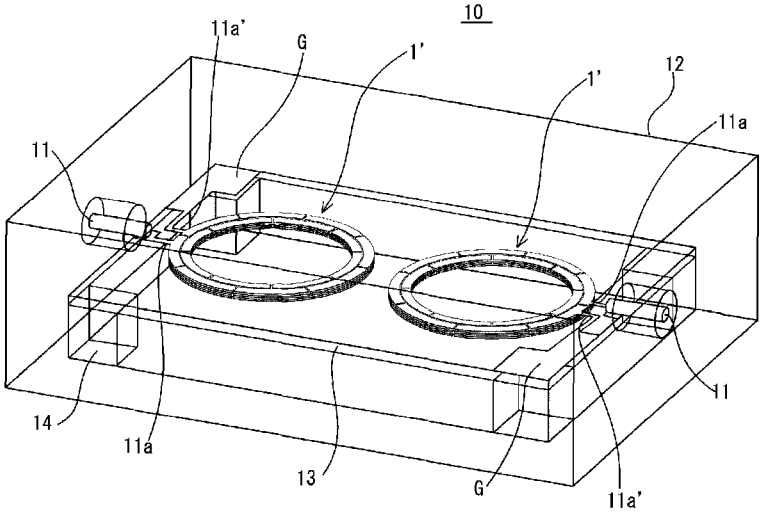
FIG. 8 is a perspective view of an artificial dielectric filter of the same.
Figure 9:
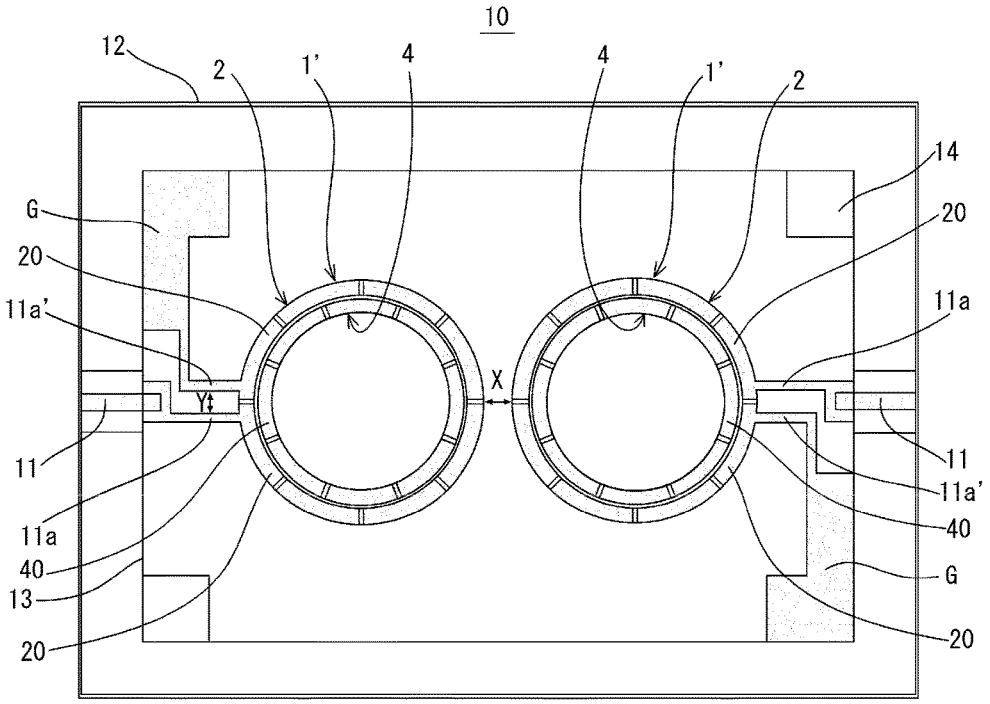
FIG. 9 is a plan view of an inside of the artificial dielectric filter of the same.

Next, an artificial dielectric filter 10 will be described. As shown in FIGS. 8 and 9, the artificial dielectric filter 10 includes a plurality of artificial dielectric resonators 1' and 1' and two input/output terminals 11 and 11. The respective artificial dielectric resonators 1' and 1' are retained by being disposed in a base material 13 in a case 12, and the adjacent artificial dielectric resonators 1' and 1' are coupled to each other by an electromagnetic field. The respective input/output terminals 11 and 11 are fastened to the case 12, the input/output terminals 11 are coupled to the artificial dielectric resonators 1' adjacent to the input/output terminals 11. Note that reference sign 14 in FIG. 8 designates a support member that supports the base material 13.

Note that the number of artificial dielectric resonators 1' and 1' is not limited, and may be two, or three or more. Further, while in the present embodiment, the aforementioned artificial dielectric resonators 1' and 1' are used as shown in FIGS. 8 and 9, the aforementioned artificial dielectric resonators 1 and 1 may be used.

For the purpose of coupling of the artificial dielectric resonator 1' and the input/output terminal 11, the input/output terminal 11 of the artificial dielectric filter 10 is directly connected to the metal strip 20 of the artificial dielectric resonator F. The direct connection is enabled because the artificial dielectric resonator 1' has the separate metal strips 20, 20, . . . . In more detail, a probe section 11*a* that is a section which directly connects the input/output terminal 11 to the metal strip 20 is provided, and a probe section 11*a*' that is a section which directly connects the metal strips 20 other than the metal strip 20 which is connected to the probe section 11*a* to a ground section G is provided. The probe sections 11*a* and 11*a*' are formed in layers (metal layers) which are the same as the first series metal strip group 2 and the third series metal strip group 4.

By the direction connection, an input/output connection degree between the input/output terminal 11 and the artificial dielectric resonator 1' is increased, and can be brought close to the inter-stage coupling degree of the artificial dielectric resonators 1' and F. If the input/output coupling degree is brought close to the inter-stage coupling degree, the band width of the filter characteristic of the entire artificial dielectric filter 10 is restrained from becoming narrower than a relative band of the filter characteristic between the artificial dielectric resonators 1' and F. Further, by the direct connection, wiring for coupling of the input/output terminal 11 and the artificial dielectric resonator 1' is fastened, and the input/output coupling degree is stabilized. Further, an additional layer as shown in a reference example described later is not required or a large area for coupling is not required, for the purpose of coupling the input/output terminal 11 and the artificial dielectric resonator 1', and therefore, the direct connection also contributes to downsizing.

Further, the plurality of artificial dielectric resonators 1' and 1' of the artificial dielectric filter 10 are both formed in an integral multilayer substrate which is the base material 13. Thereby, relative position of the plurality of artificial dielectric resonators 1' and 1' is fastened, and a predetermined inter-stage coupling degree is obtained. As the multilayer substrate, a resin multilayer substrate, an LTCC (low temperature co-fire ceramics) substrate and the like can be used.

A simulation analysis result of the artificial dielectric filter 10 will be shown as follows. In the analysis, three-dimensional electromagnetic simulation software HFSS is used. The thickness of the metal layer is 18 μm, and five layers are stacked. As for the base material, a relative dielectric constant is set at 2.4 and dielectric loss is set at 0.00114. In the artificial dielectric resonator 1', the width of the metal strip is set at 0.8 mm, and all the gaps each between the two metal strips in the same layer are all set at 0.2 mm. An outside diameter of the first series metal strip group 2 which forms an annular shape is set at 8.4 mm. Widths of the probe sections 11*a* and 11*a'* were set at 0.5 mm. Note that although explanation will be omitted because it is not the gist of the invention, the numeric value showing the input/output coupling degree in the characteristic diagram in the analysis is a value which is a so-called external k, and the numeric value showing the inter-stage coupling degree is a value which is a so-called a coupling constant.

Figure 10:
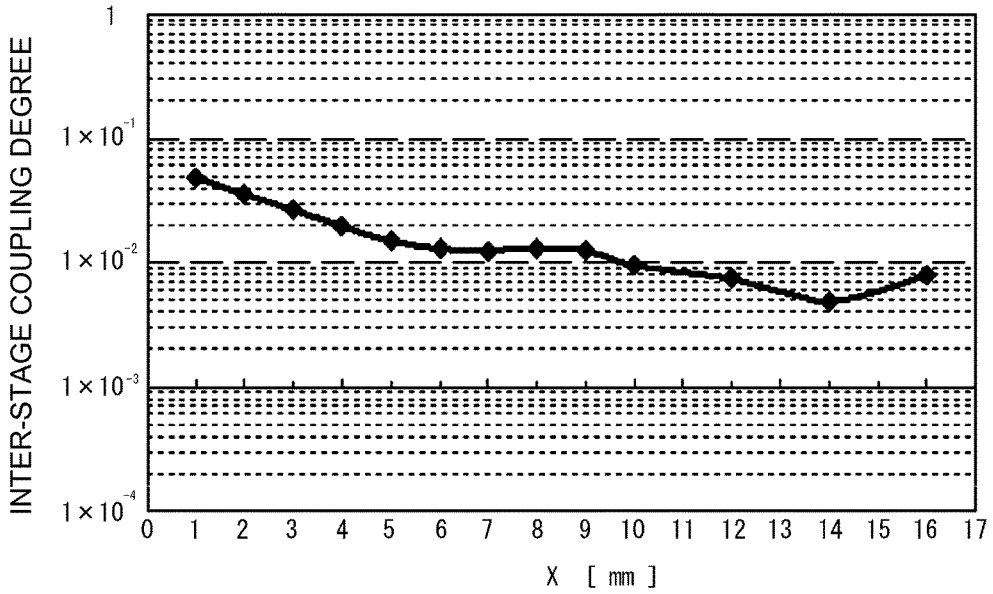
FIG. 10 is a characteristic diagram of an inter-stage coupling degree of the artificial dielectric filter of the same.

FIG. 10 shows a characteristic of the inter-stage coupling degree of the artificial dielectric filter 10. The axis of abscissa of FIG. 10 represents a distance X between the two artificial dielectric resonators 1' and F. Where the distance X between the artificial dielectric resonators 1' and 1' is short, the inter-stage coupling degree is in the order of $10^{-2}$. Further, if the distance between the artificial dielectric resonators 1' and 1' becomes short within the range, the inter-stage coupling degree increases relatively abruptly. Thereby, it proves to be effective to form the two artificial dielectric resonators 1' and 1' in the integral multilayer substrate and fix the relative position thereof.

Figure 11:
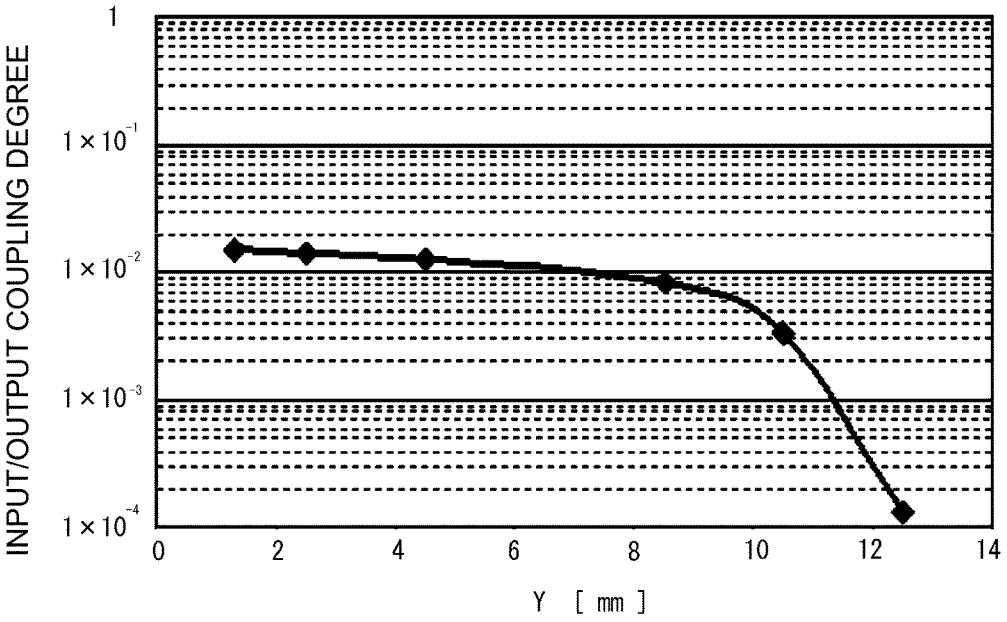
FIG. 11 is a characteristic diagram of an input/output coupling degree of the artificial dielectric filter of the same.

FIG. 11 shows a characteristic of the input/output coupling degree of the artificial dielectric filter 10. The axis of abscissa of FIG. 11 represents a distance Y between the probe section 11*a* and the probe section 11*a'* of the input/output terminal 11. Where the distance Y of the probe section 11*a* and the probe section 11*a'* is short, the input/output degree can be achieved in the order of $10^{-2}$, and is a value close to the inter-stage coupling degree. Thereby, it is found out that if the input/output terminal 11 is directly connected to the artificial dielectric resonator 1', the band width of the filter characteristic of the entire artificial dielectric filter 10 can be restrained from being narrowed.

Figure 12:
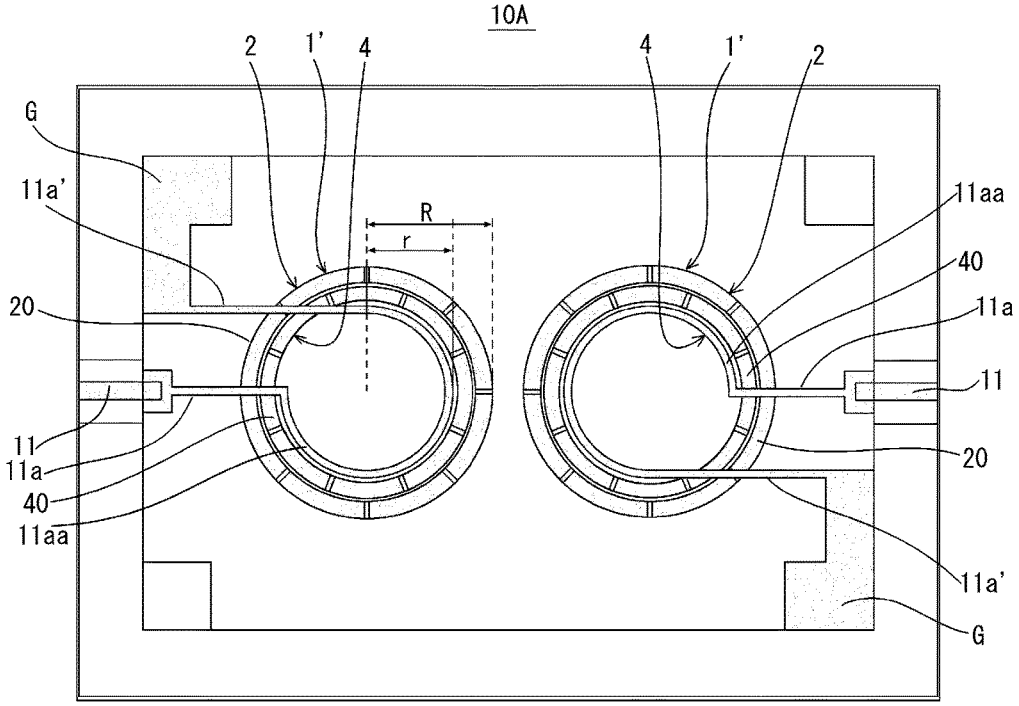
FIG. 12 is a plan view of an inside of an artificial dielectric filter in which an input/output method of the artificial dielectric filter of the same is changed.

Note that FIG. 12 shows an artificial dielectric filter 10A as a reference example. The artificial dielectric filter 10A is such that a loop-shaped section 11*aa* is provided at the probe section 11*a* of the input/output terminal 11 and is coupled to the artificial dielectric resonator 1' via a gap, without directly connecting the input/output terminal 11 to the metal strip 20 of the artificial dielectric resonator F. This is such that when the basic mode is a TE01δ mode, a lot of magnetic field energy is present around the artificial dielectric resonator 1', and the artificial dielectric resonator 1' and the loop-shaped section 11*aa* mutually capture the magnetic field energy, and thereby are coupled (magnetic coupling) to each other.

Figure 13:
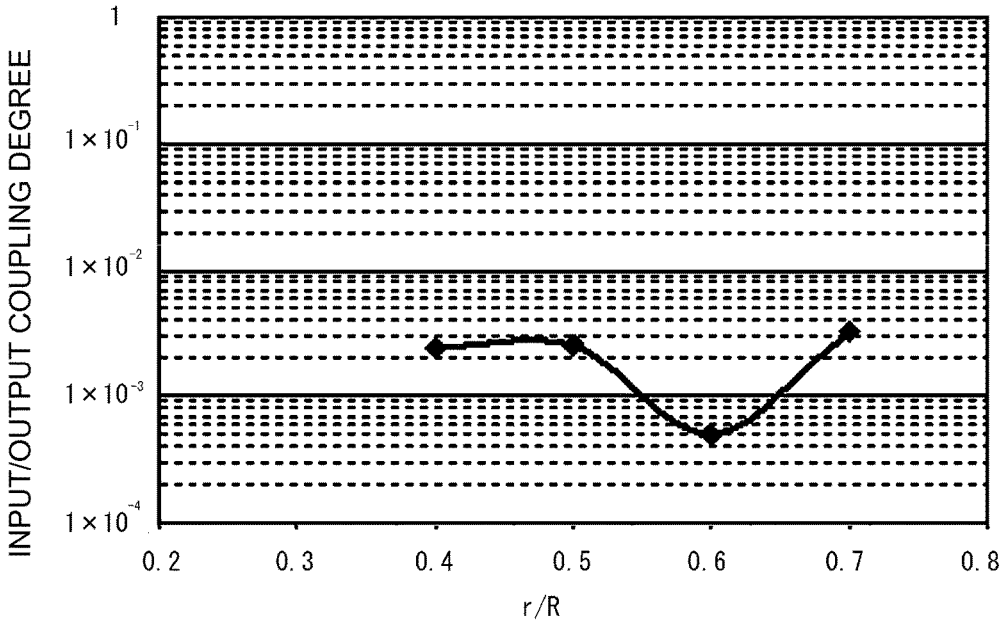
FIG. 13 is a characteristic diagram of an input/output coupling degree of the artificial dielectric filter in which the input/output method of the artificial dielectric filter of the same is changed.

FIG. 13 shows a characteristic of the input/output coupling degree of the artificial dielectric filter 10A. It is found out that the input/output coupling degree cannot be achieved in the order of $10^{-2}$. This is because however close the artificial dielectric resonator 1' and the loop-shaped section 11*aa* are brought to each other, the magnetic energy which the artificial dielectric resonator 1' and the loop-shaped section 11*aa* can mutually capture is limited. Note that the axis of abscissa of FIG. 13 is a ratio of a radius r of the loop-shaped section 11*aa* and a radius R of an outer circumference of the first series metal strip group 2.

While the artificial dielectric resonator and the artificial dielectric filter using the same according to the embodiment of the present invention are described thus far, the present invention is not limited to what is described in the aforementioned embodiment, and various design changes within the range of the matters described in claims can be made. For example, in addition to the configuration of the aforementioned artificial dielectric resonator 1', the metal strip group which is similar to the first series metal strip group 2 and the third series metal strip group 4 and is close to them in the width direction can be properly increased. Further, while the one in which the input/output terminal 11 of the artificial dielectric filter 10 and the metal strip 20 of the first series metal strip group 2 are directly connected is described, the art of the direct connection is applicable without being limited to the detailed configuration of the artificial dielectric resonator 1' (or 1) if only the artificial dielectric resonator has the aforementioned first series metal strip group 2.

REFERENCE SIGNS LIST

1 Artificial dielectric resonator
10 Artificial dielectric filter
11 Input/output terminal
2 First series metal strip group
20 Metal strip of first series metal strip group
20G Gap of metal strips of first series metal strip group
3 Second series metal strip group
30 Metal strip of second series metal strip group
30G Gap of metal strips of second series metal strip group
4 Third series metal strip group
40 Metal strip of third series metal strip group
40G Gap of metal strips of third series metal strip group
5 Fourth series metal strip group
50 Metal strip of fourth series metal strip group
50G Gap of metal strips of fourth series metal strip group

What is claimed is:

1. An artificial dielectric resonator, comprising:

a first series metal strip group including a plurality of metal strips forming an annular shape and each in a thin sheet shape arranged with microscopic gaps provided in a longitudinal direction; and a second series metal strip group including a plurality of metal strips forming an annular shape and each in a thin sheet shape arranged with microscopic gaps provided in a longitudinal direction, wherein the center of the second series metal strip group does not contain any additional metal strip groups;

a third series metal strip group that includes a plurality of metal strips each in a thin sheet shape arranged with microscopic gaps provided in a longitudinal direction and forming an annular shape, the third series metal strip group being disposed coaxially and longitudinally with the first series metal strip group; and a fourth series metal strip group that includes a plurality of metal strips each in a thin sheet shape arranged with microscopic gaps provided in a longitudinal direction and forming an annular shape, the fourth series metal strip group being disposed coaxially and longitudinally with the second series metal strip group, wherein each metal strip of the first series metal strip group is disposed to face and extend across a microscopic gap of the microscopic gaps arranged in the plurality of metal strips included in the second series metal strip group.

2. An artificial dielectric filter, comprising:

a plurality of artificial dielectric resonators coupled to each other and disposed adjacent to each other; and a first input/output terminal coupled to a first artificial dielectric resonator of the plurality of artificial dielectric resonators to which it is adjacent; and a second input/output terminal coupled to a second artificial dielectric resonator to which it is adjacent, wherein each of the plurality of artificial dielectric resonators includes:

a first series metal strip group including a plurality of metal strips forming an annular shape and each in a thin sheet shape arranged with microscopic gaps provided in a longitudinal direction; and a second series metal strip group including a plurality of metal strips forming an annular shape and each in a thin sheet shape arranged with microscopic gaps provided in a longitudinal direction, wherein the center of the second series metal strip group does not contain any additional metal strip groups;

a third series metal strip group that includes a plurality of metal strips each in a thin sheet shape arranged with microscopic gaps provided in a longitudinal direction and forming an annular shape, the third series metal strip group being disposed coaxially and longitudinally with the first series metal strip group; and a fourth series metal strip group that includes a plurality of metal strips each in a thin sheet shape arranged with microscopic gaps provided in a longitudinal direction and forming an annular shape, the fourth series metal strip group being disposed coaxially and longitudinally with the second series metal strip group wherein each metal strip of the first series metal strip group is disposed to face and extend across a microscopic gap of the microscopic gaps arranged in the plurality of metal strips included in the second series metal strip group.

3. The artificial dielectric filter according to claim 2, wherein each of the plurality of artificial dielectric resonators is disposed within an integral multilayer substrate at a fixed position relative to each of the other artificial dielectric resonators to achieve a predetermined inter-stage coupling degree.

4. The artificial dielectric filter according to claim 2, wherein each of the plurality of artificial dielectric resonators is disposed within an integral multilayer substrate at a fixed position relative to each of the other artificial dielectric resonators to achieve a predetermined inter-stage coupling degree.

5. The artificial dielectric filter according to claim 2, wherein each of the plurality of artificial dielectric resonators is disposed within an integral multilayer substrate at a fixed position relative to each of the other artificial dielectric resonators to achieve a predetermined inter-stage coupling degree.

6. The artificial dielectric filter according to claim 2, wherein one or more of the plurality of artificial dielectric resonators resonates with a basic mode set as a TE01δ mode.

7. The artificial dielectric filter according to claim 2, wherein each of the input/output terminals is directly connected to one or more of the plurality of metal strips included in one of the series metal strip groups of the artificial dielectric resonator to which it is adjacent.

8. The artificial dielectric filter according to claim 7, wherein each of the plurality of artificial dielectric resonators is disposed within an integral multilayer substrate at a fixed position relative to each of the other artificial dielectric resonators to achieve a predetermined inter-stage coupling degree.

* * * * *